United States Patent [19]

Teragaki et al.

[11] 4,273,396

[45] Jun. 16, 1981

[54] DISPLAY UNIT

[75] Inventors: Takeshi Teragaki; Yasuya Ohno, both of Tokyo; Etsuso Yokoyama, Tachikawa, all of Japan

[73] Assignee: T.I.C. - Citizen Co., Ltd., Tokyo, Japan

[21] Appl. No.: 37,282

[22] Filed: May 9, 1979

[30] Foreign Application Priority Data

Feb. 9, 1979 [JP] Japan ..... 54-16445[U]

[51] Int. Cl.[3] ..... A47B 77/08; G08B 5/22

[52] U.S. Cl. ..... 312/223; 312/125; 353/71; 340/373; 40/326

[58] Field of Search ..... 312/223, 125; 40/326; 353/71; 340/373

[56] References Cited

U.S. PATENT DOCUMENTS

| | | | |
|---|---|---|---|
| 1,778,857 | 10/1930 | James | 312/223 |
| 1,938,514 | 12/1933 | Carlson | 312/223 |
| 1,969,306 | 8/1934 | Hunter | 312/223 |
| 2,141,473 | 12/1938 | Hubertz | 340/373 R |
| 2,252,552 | 8/1941 | Kingston | 353/71 |
| 2,473,736 | 6/1949 | Stern | 353/71 |
| 2,651,967 | 9/1953 | Thomas | 312/223 |
| 3,295,238 | 1/1967 | Winrow | 40/326 |
| 3,303,494 | 2/1967 | Taylor et al. | 340/373 R |
| 3,387,535 | 6/1968 | Bennett | 353/71 |
| 3,469,258 | 9/1969 | Winrow | 340/373 R |
| 3,634,857 | 1/1972 | Pihl | 340/373 R |
| 3,731,303 | 5/1973 | Wohlbach | 340/373 R |
| 3,862,788 | 1/1975 | Hock et al. | 312/223 |
| 3,886,545 | 5/1975 | Skrobisch | 340/373 R |
| 3,904,286 | 9/1975 | Omi et al. | 353/71 |
| 4,092,063 | 5/1978 | Koester | 353/71 |

FOREIGN PATENT DOCUMENTS

| | | | |
|---|---|---|---|
| 28321 | 9/1931 | Australia | 40/326 |

*Primary Examiner*—Victor N. Sakran

*Attorney, Agent, or Firm*—Bernard & Brown

[57] ABSTRACT

A display unit comprising means for carrying means which moves a reflector plate to be moved between a display position which is in the proximity to or in contact with a transparent plate located on a display surface and a non-display position separated away from the display position, with the plate being rotated about an axis disposed in parallel to a surface of the plate.

10 Claims, 24 Drawing Figures

DISPLAY UNIT

BACKGROUND OF THE INVENTION

1. Field of the Invention

This invention relates to a display device for displaying characters or figures, and more particularly to a display unit having a movable reflector plate with an indication thereon.

2. Prior Art

A reflection display device of the type in which each dot positioned on a display surface is composed of a reflector plate, has the following advantages over the devices in which each of the dots is composed of a light-emitting element such as lamp: i.e., (1) clarity of the display is enhanced with the increase in the circumferential brightness, and (2) the device is free from such troubles as the breakage of lamp filament, and gives increased reliability. With the conventional devices of this type, however, the reflector plate has been so supported as to turn about its central position so that the weight that must be moved at the time of rotation can be reduced. For this purpose, space must be formed in front of the reflector plate so that the reflector plate is allowed to turn from a position where it is faced to the front surface to other position, and vice versa. The presence of space in front of the reflector plate, however, renders the surface of the reflector plate to be located behind the actual display surface causing the clarity of the indication to be decreased and further restricting the angles within which the indication can be seen. The indication will become less recognizable when each of the display units is accommodated in the individual cases. Therefore, it has so far been virtually difficult to provide a display unit accommodating the reflector plate and the mechanism for driving it in the casing to prevent the function from being deteriorated by moisture and dust.

SUMMARY OF THE INVENTION

The principal object of this invention is to provide a display unit having a reflector plate which is moved in such manner that when it faces the front surface, the display surface of the reflector plate is located at the most advanced position in the locus of its movement.

The display unit according to the invention comprises a reflector plate which moves between a display position located on a predetermined display surface and a non-display position apart from the display position, and means for controlling the rotation of the reflector plate between a position at which the reflector plate is in parallel with the display surface and a position at which the reflector plate is tilted at a predetermined angle with respect to the display surface in the course of the movement of the plate between the abovementioned display position and the non-display position. The control is effected in such a manner that when the reflector plate is located at the most advanced position, i.e., when the reflector plate is located in a predetermined region near the display position, the reflector plate is moved in a direction nearly perpendicular to the surface of reflection.

Such a movement of the reflector plate permits a panel to be in the proximity to or in contact with the surface of reflection plate when the reflector plate is at the display position. According to a preferred aspect of the invention, the panel forms a portion of the case which accommodates necessary elements of the display device.

DESCRIPTION OF THE PREFERRED EMBODIMENTS

Figure 1:
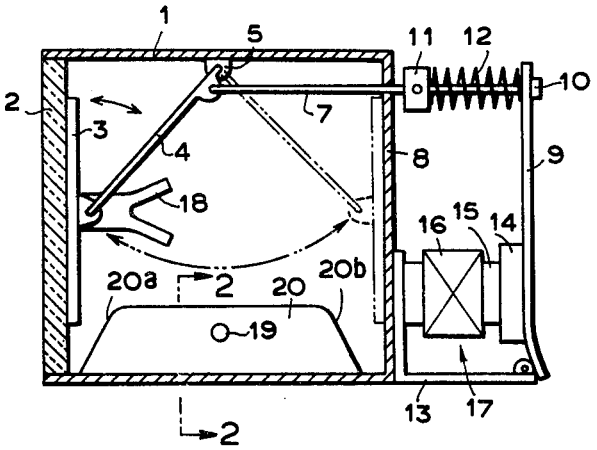
FIG. 1 is a side view showing a display unit according to this invention in a partially cut-away manner.

Referring now to the drawings, especially to FIG. 1, a casing 1 which is preferably made of a plastics material is nearly of a cubic shape, with its one wall, i.e., with a front wall 2 being transparent. A reflector plate 3 having a high reflection factor on the front surface thereof is accommodated in the casing 1, and is movable between a first position or a display position indicated by a solid line in FIG. 1 and a second position or a non-display position indicated by a chain line. When the reflector plate 3 is located at the display position, the reflecting surface is in contact with the inner surface of the front wall 2 of the casing 1, whereby the incident light introduced through the front wall 2 is efficiently reflected and is emitted toward outside through the front wall 2 again. When the reflector plate 3 is located at the non-display position, on the other hand, substantially no light is reflected at the inside of the transparent wall 2; the light reflected by the wall 2 toward outside is very weak. The back surface of the reflector plate 3 and the inner surfaces of the casing 1 should preferably have a small reflection factor, and more preferably have black color, so that the difference in intensity of light emitted toward the external side through the wall 2 is increased or, in other words, the contrast is increased depending upon whether the reflector plate 3 is located or not located at the display position.

Figure 3:
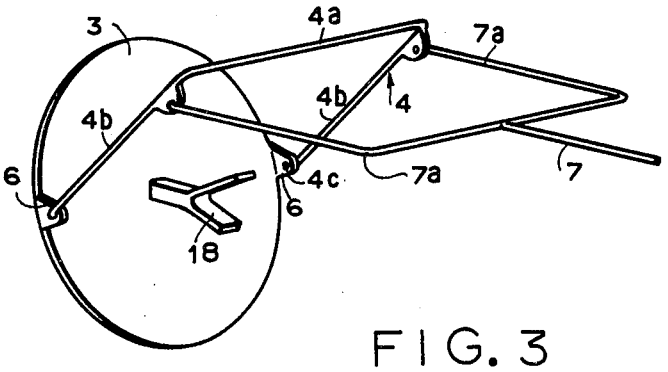
FIG. 3 is a perspective view showing a reflector plate used in the display unit of FIG. 1 and a portion of the mechanism for actuating the reflector plate.

A lever 4 which so supports the reflector plate 3 that it moves between the display position and the non-display position, consists, as shown in FIG. 3, of a portion 4*a* which penetrates through a bearing 5 downwardly protruded from the top wall of the casing 1, and a pair of portions 4*b* downwardly extending from both ends of the above portion 4*a*. Tip portions 4*c* of the portions 4*b* are connected to a pair of bearings 6 formed on the back surface of the reflector plate 3. Therefore, the reflector plate 3 is rotatable about the portions 4*c* with respect to the lever 4, and is further allowed to rotate about the portion 4*a* together with the lever 4.

A mechanism for rotating the lever 4 about the portion 4*a* within a predetermined range, i.e., between the position indicated by a solid line and the position indicated by a dotted line in FIG. 1, is equipped with a drive rod 7 having two legs 7*a* pivoted to the portions 4*b* of the lever 4. The drive rod 7 is outwardly protruded beyond the casing penetrating through a rear wall of the casing, passes through a moving plate 9 and has a stop 10 at its end portion. The drive rod 7 has a member 11 which restricts one end of the axial movement thereof. Further, a compression spring 12 is inserted between the member 11 and the moving plate 9, so that the drive rod 7 is urged toward a direction in which the stop 10 is pressed onto the moving plate 9.

The moving plate 9 is hinged to a tip of a nearly L-shaped bracket 13 which is fastened to the rear wall of the casing 1 in such a manner that the center of its rotation is in parallel with the center of rotation of the lever 4. Preferably, the moving plate 9 has a permanent magnet piece 14 which is magnetized in the direction of the thickness. The magnet piece 14 is disposed at a position opposite to a solenoid 17 which is mounted on the bracket 13 and which consists of a core 15 and a coil 16. Therefore, when an electric current is fed to the coil 16, a magnetic field, of which polarity is determined by the direction of an electric current, is established at the end of the core 15, such that the magnet piece 14 is attracted or repelled by the core 15. According to this embodiment, the piece 14 composed of a permanent magnet remains intimately contacted to the core 15 even after the supply of electric current to the coil 16 has been discontinued, provided the piece 14 has been brought into contact with the core 15. However, when the device is so constructed that a necessary electric current is always allowed to flow into the coil 16, the piece 14 may be composed of iron.

Means for rotating the reflector plate 3 responsive to the rotation of the lever 4 and relative to the lever 4, includes a fork-shaped engaging member 18 provided on the back surface of the reflector of the reflector plate 3, a projection 19 which engages with the engaging member 18, and a projection or a cam 20 having two engaging surfaces 20*a* and 20*b*. As will be seen from FIG. 2, the cam 20 has the shape of a plate disposed nearly perpendiculary to the bottom of the casing 1, and the projection 19 extends from one side of the cam 20 in a direction perpendicular thereto, i.e., in a direction in parallel with the center of rotation of the lever 4.

FIG. 1 shows a state in which the permanent magnet piece 14 is in contact with the core 15. Under this state, the moving plate 9 is held at an end of its rotational range in the counterclockwise direction thereby to push the drive rod 7 toward the left in FIG. 1 by means of the spring 12. The movement of the drive rod 7 causes the lever 4 to turn clockwise, so that the reflector plate 3 is so pushed as to come into contact with the inner surface of the front wall 2. In other words, when the piece 14 is in contact with the core 15, the reflector plate 3 is held at the display position.

To move the reflector plate 3 from the display position to the non-display position, an electric current is supplied to the coil 17 so that the piece 14 leaves the core 15. The magnetic force acting upon the piece 14 causes the moving plate 9 to turn clockwise, whereby the drive rod 7 is moved toward the right and the lever 4 is turned counterclockwise. As the reflector plate 3 is away from the front wall 2 accompanying the rotation of the lever 4, the lower portion of the reflector plate comes into engagement with an engaging surface 20*a* of the cam 20 and is moved being lagged behind the center of rotation of the reflector plate 3. Hence, as the lever 4 is rotated, the reflector plate 3 is caused to turn clockwise about the portions 4*c* of the lever 4 while the projection 19 enters between two fingers of the engaging member 18. The engagement between the engaging member 18 and the projection 19 contributes to quicken the turn of the reflector plate 3 which is being moved accompanying the turn of the lever 4. When moved to a position where the engagement will be cancelled, the reflector plate 3 will have been so turned that the surface of reflection is faced in a direction opposite to the front wall 2, i.e., the surface of reflection is faced to the rear wall 8 and is, eventually, brought into intimate contact with the rear wall 8.

When the electric is fed to the coil 16 in such a direction that the established magnetic force acts to pull the permanent magnet piece 14 toward the core 15, the moving plate 9 rotates in the counterclockwise direction, whereby the drive rod 7 is moved toward the left and the lever 4 rotates in the clockwise direction. Consequently, the reflector plate 3 gets away from the rear wall 8 and counterclockwise upon contact with the engaging surface 20*b*. The operation, thereafter, is the same as when the reflector plate 3 is moved from the display position to the non-display position, except that the direction of operation is reversed. Here, attention should be given to that in the final stage of the movement, the reflector plate 3 is allowed to approach the front wall 2 without at all any rotation. Owing to the abovementioned mode of movement, the reflector plate 3, when it is at the display position, is allowed to be located in front of any members used for moving it and is further allowed to come into contact with the front wall 2. This is a very important factor for obtaining clear display effect and for accommodating the moving members in the casing.

Figure 2:
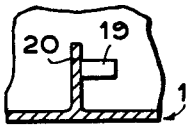
FIG. 2 is a sectional view along a line 2—2 of FIG. 1.
Figure 4:
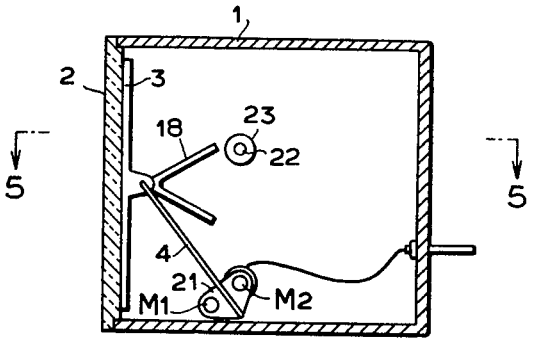
FIG. 4 is a vertical longitudinal section showing a display unit according to another embodiment of this invention.
Figure 5:
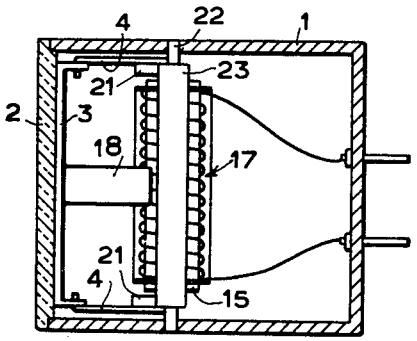
FIG. 5 is a sectional view along a line 5—5 of FIG. 4.
Figure 6:
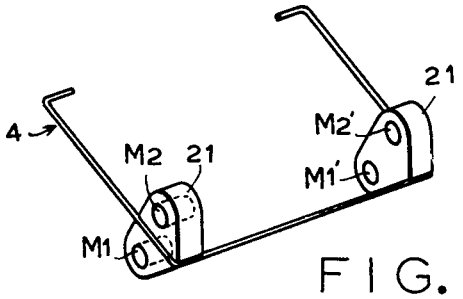
FIG. 6 is a perspective view showing a portion of a mechanism for actuating the reflector plate used in the display unit of FIGS. 4 and 5.

FIGS. 4 to 6 show a modified embodiment of the display unit of this invention, in which the same or equivalent parts shown in the embodiment of FIGS. 1 to 3 are denoted by the same reference numerals. According to this embodiment, a pair of support members 21 are fastened in an opposing manner to a lever 4 which supports a reflector plate 3, and two pairs of permanent magnet pieces $M_1$ and $M_2$ of a cylindrical shape are supported by each of the support members 21. A solenoid 17 is so located on the bottom of the casing 1 that a core 15 is located between the support members 21. The permanent magnet pieces $M_1$ are so positioned as to face the end portions of the core 15 when the reflector plate 3 is located at the display position, and the permanent magnet pieces $M_2$ are so positioned as to face the end portions of the core 15 when the reflector plate 3 is located at the non-display position. The polarities at the end portions of the magnet pieces $M_1$ and $M_2$ are opposite to the polarities at the corresponding end portions of the core 15. Therefore, by selecting the direction of electric current flowing through the coil 16, it is allowed to rotate the lever 4 from one end to the other end and vice versa within the rotatable angle.

According to this embodiment, an engaging member 18 attached to the back surface of the reflector plate 3 has longer fingers than those employed in the embodiment of FIGS. 1 to 3, and their tips are always located in the vicinity of a roller 23 supported by a shaft 22 irrespective of whether the reflector plate 3 is located at the display position or the non-display position. Therefore, as soon as the reflector plate 3 starts to move from the display position toward the nondisplay position and vice versa, the engaging member 18 comes into contact with the roller 23 so that the reflector plate 3 is turned. The roller 23 is allowed to freely rotate upon contact with the engaging member 18 thereby to reduce the load exerted on the lever 4. Namely, in the embodiment shown in FIGS. 4 to 6, the reflector plate and the mechanism for moving the reflector plate are accommodated in the casing 1, obviating the need of the cam employed in the embodiment shown in FIGS. 1 to 3.

Figure 7:
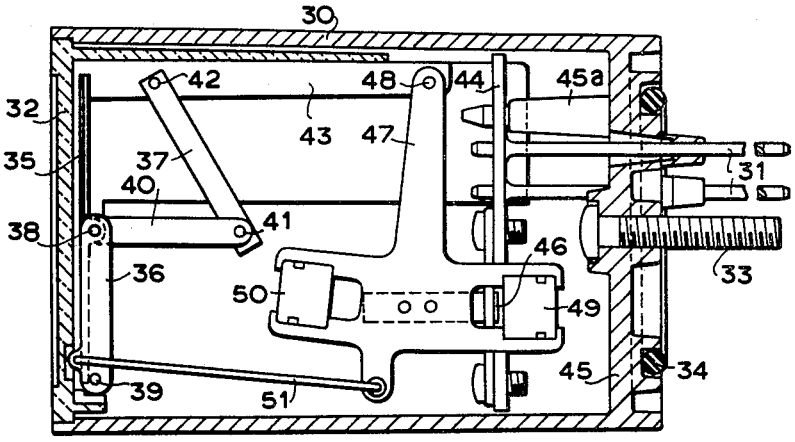
FIG. 7 is a longitudinal section showing a display unit according to a further embodiment of this invention.

Referring to a modified display unit according to this invention shown in FIG. 7, a casing designated at 30 is formed in a generally square cylindrical shape, and a transparent plate 32 made of a plastics material is fitted to one end to form a display surface. The other end of the casing 30 is closed by a member made of the same material as that of the casing 30, to which terminal pins 31 are studded. A bolt 33 for mounting is also studded. By fitting a nut to the bolt 33, the casing 30 can be attached to a mounting plate (not shown). An O-ring 34 is provided for preventing rain water infiltrated to be transferred to the back side of the mounting plate through a hole of bolt 33 or holes of terminal pins 32. Thus, the display unit is assembled in a water-proof construction to be resistant against the weather even when it is used being directly exposes to the open air.

Figure 8:
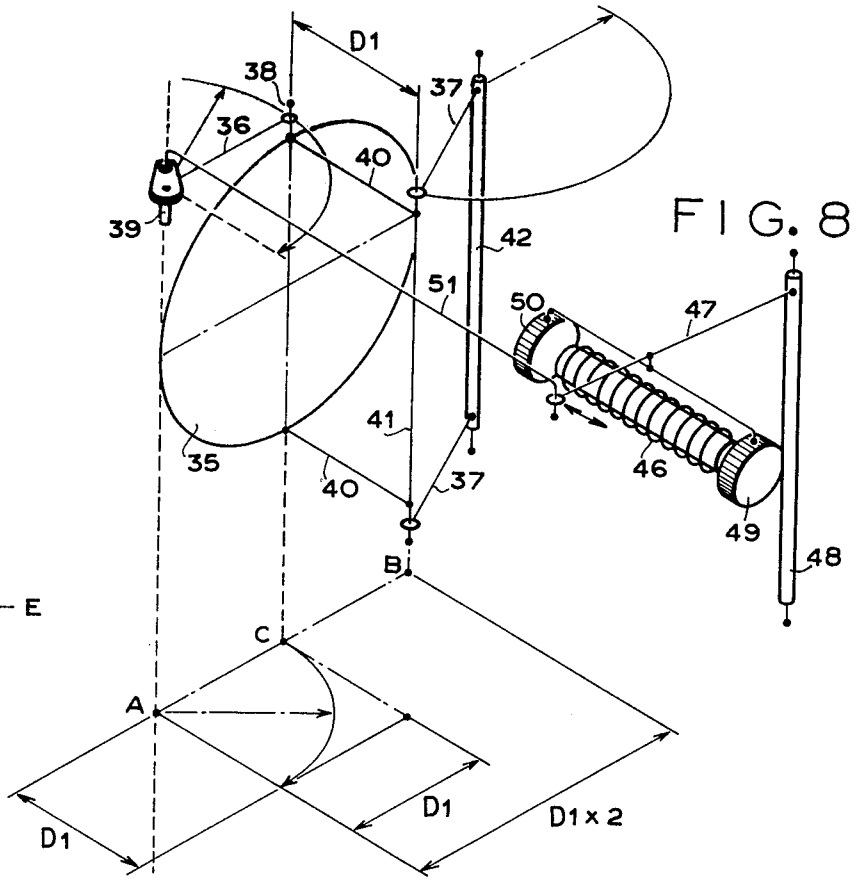
FIG. 8 is a perspective view schematically showing the geometrical arrangement of the display unit of FIG. 7.
Figure 9:
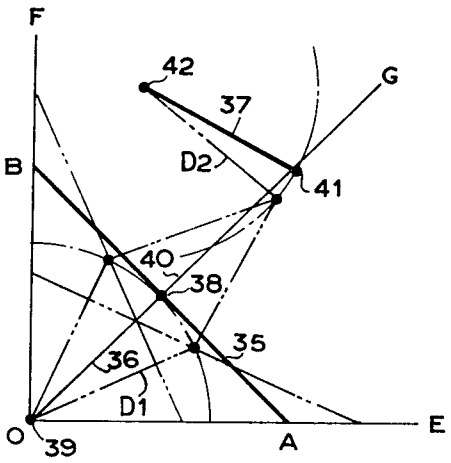
FIG. 9 is a diagram showing a relation in positions of each of the members of the display unit of FIG. 7.

The casing 30 accommodates a reflector plate 35 and a mechanism for supporting it to be moved between the display position and the non-display position. FIG. 8 schematically shows the lengths of the reflector plate and each of the elements of the drive mechanism, as well as the positions of their connections, and FIG. 9 shows the loci of movements of each of the elements accompanying the movement of the reflector plate 35. The mechanism which supports the reflector plate 35 and moves it between the display position (position shown in FIG. 7) and the non-display position, at which the reflector plate 35 is turned by about 90 degrees in the counterclockwise direction in FIG. 7 and at which the surface of reflection faces downwards, pertains to a widely known Scott-Russel mechanism. Namely, this mechanism possesses two levers 36 and 37, the first lever 36 being connected at its one end to the reflector plate 35 so as to rotate about a pivot 38 located on the back side of the reflector plate 35, and is supported at its other end by the front wall 32 so as to turn about a pivot 39 which is in parallel with the pivot 38. As will be clear from FIG. 8, the pivot 38 passes through the center of the reflector plate 35—though the reflector plate is formed in a circular shape in this embodiment, it may be formed in any shape such as square shape, hexagonal shape, etc.—and lies on a plane in parallel with the surface of the reflector plate 35. More in detail, let it be supposed that a plane is perpendicular to an extension of the pivot 38 and intersects the extension at a point C. Two straight lines which pass through the outermost sides of the reflector plate 35 at portions most remote from the pivot 38 in parallel with each other, intersect the plane at points A and B, where the distance between the points A and C is equal to the distance between the points B and C. In FIG. 8, for the sake of better understanding, let it be assumed that the pivot 38 is located on the surface of reflection surface of the reflector plate 35, and the pivot 39 is disposed on a line which passes through the point A.

The reflector plate 35 has a pair of arms 40 which extend backwardly and are rotatably connected at their ends to the end of the lever 37 via a pivot 41 which is in parallel with the pivot 38. The lever 37 is supported by a support wall 43 which is formed in unitary with the front wall 32 and backwardly extends along the inner surface of the casing 30. The lever 37 can rotate about the pivot 42 which is in parallel with the pivot 38. In other words, the pivots 38, 39, 41 and 42 are in parallel with one another.

A printed circuit board 44 is accommodated in the casing 30 and secured at a predetermined position by means of support poles 45*a* (only one support pole is shown in FIG. 7) which are formed on a rear wall 45 of the casing 30. To the printed circuit board 44 is fitted a solenoid 46 comprising a core and a coil wound around thereof, and a wiring pattern for connecting both ends of the coil to the terminal pins 31.

A swing arm 47 accommodated in the casing 30 is allowed to swing about a pivot 48 in parallel with the pivot 39, and has a permanent magnet piece 49 which comes into contact with one end of the solenoid 46 when the swing arm 47 is located at one end in the turning range, as well as a permanent magnet piece 50 which comes into contact with the other end of the solenoid 46 when the swing arm 47 is located at the other end in the turning range. A free end of the swing arm 47 is connected to a lever 36 via a connection member 51.

When the swing arm 47 is caused to swing due to the magnetic attraction or replusion acting between the solenoid 46 and permanent magnet pieces 49, 50, the swinging motion is transmitted to the first lever 36 via the connection member 51, so that the first lever 36 is turned in the clockwise or counterclockwise direction in FIG. 7 with the pivot 39 as a center and over a range of about 90 degrees. FIG. 7 shows the state in which the lever 36 is placed at one end of its rotation. When the swing arm 47 is caused to swing toward the right in FIG. 7, the lever 38 connected to the swing arm 47 via the connection member 51 is rotated in the clockwise direction about the pivot 39, whereby the pivot 38 moves on an arc which is described with the distance $D_1$ between the pivot 38 and the pivot 39 is a radius. In this case, since the pivot 41 on the arm 40 is restricted to move on the arc with the pivot 42 as a center, the arm 40 rotates counterclockwise about the pivot 41 accompanying the movement of the pivot 38. Further, as the swing arm 47 swings toward the left, each of the portions moves in the direction opposite to the abovementioned direction taking along the same locus.

Movement of each of the portions will be described below with reference to FIG. 9. When the reflector plate 35 is so rotated that one end A moves along a line $\overline{OE}$ and another end B moves along a line $\overline{OF}$, the pivot 38 moves on the arc of radius $D_1$ with the pivot 39 as a center, and the pivot 41 moves on the arc having a radius equal to the distance $D_2$ between the pivot 42 and the pivot 41 with the pivot 42 as a center. It will therefore be understood that the reflector plate 35 is so rotated that both ends move on the lines that intersect perpendicularly with each other when the pivot 38 is so moved along the arc having center at the pivot 39 that the pivot 41 moves along a line $\overline{OG}$ or moves along the vicinity of the line $\overline{OG}$. The display plate 35 is located at the display position when the points A and B are located on the line $\overline{OF}$ and is located at the nondisplay position when the points A and B are located on the line $\overline{OE}$. According to this invention, only the display position and the non-display position are important and there is no need that the points A and B move on the straight lines between the abovementioned two positions. Therefore, there is no virtual trouble even if the locus of the pivot 41 does not come into complete agreement with the line $\overline{OG}$.

Figure 10:
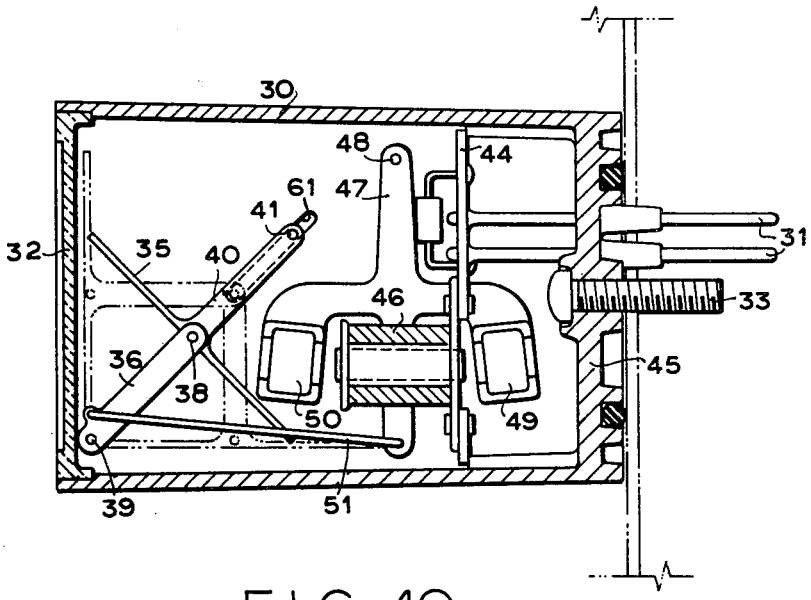
FIG. 10 is a vertical cross-sectional view showing another display embodying this invention.
Figure 11:
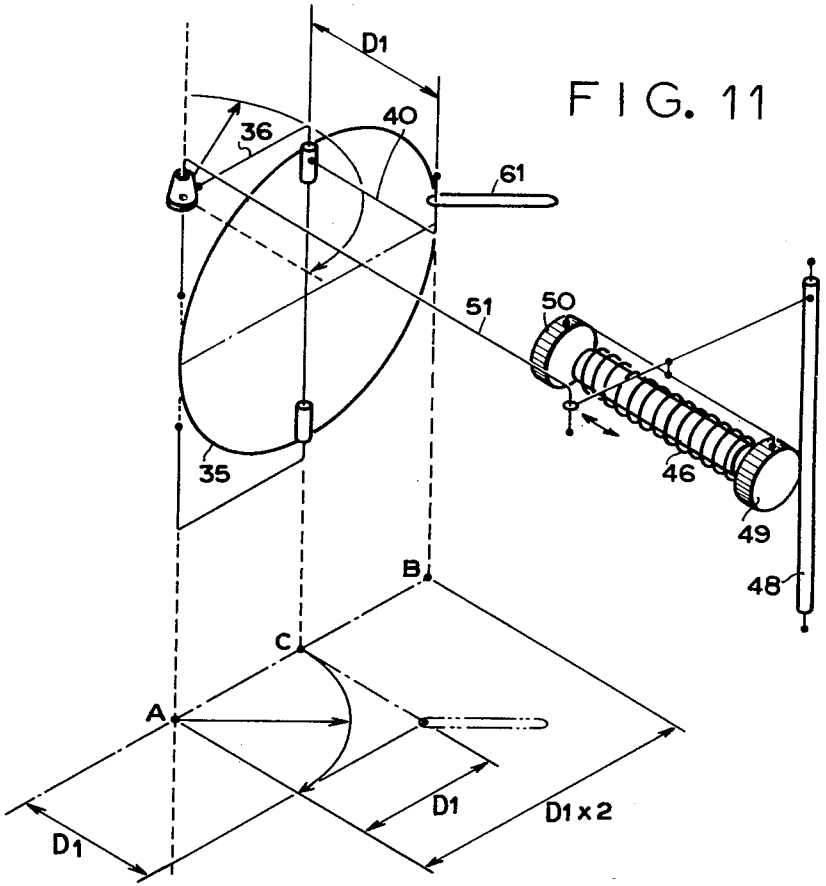
FIG. 11 is a perspective view showing the geometrical arrangement of each of the members of the display unit of FIG. 10.

FIG. 10 shows a modification wherein the pivot 41 of the arm 40 of the reflector plate 35 can move along the line $\overline{OG}$ of FIG. 9, wherein the portions equivalent to those of FIG. 7 are denoted by the same reference numerals. According to this embodiment, both ends of the pivot 41 have been fitted into grooves 61 formed in the walls on both sides of the casing 30. Therefore, when the rotation of the lever 36 is effected, the pivot 41 moves in the lengthwise direction of the grooves 61 thereby to control the turn of the reflector plate 35. Relations of principal elements of the display unit of FIG. 10 are shown in FIG. 11, and relations in relative positions of the reflector plate 35 and the lever 36 moving between the display position and the non-display position are shown in FIGS. 12*a* to 12*e*.

Figure 13:
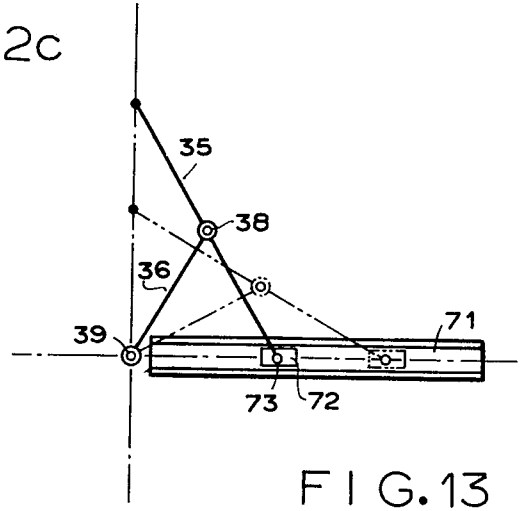
FIG. 13 is a side view schematically showing a major portion of a display unit according to still another embodiment of this invention.
Figure 12D:
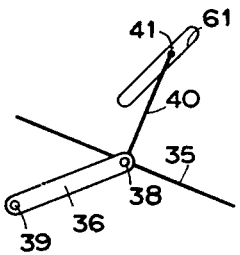
Figure 12E:
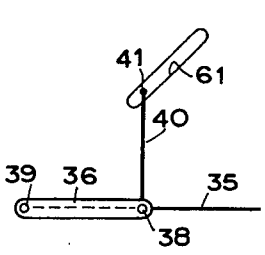
Figure 15A:
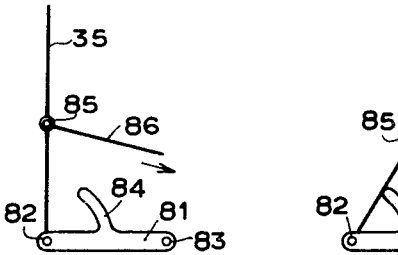
FIGS. 15*a* to 15*e* are side views schematically showing the sequence of operation of each of the members of FIG. 14.
Figure 15B:
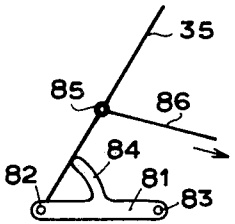
Figure 15C:
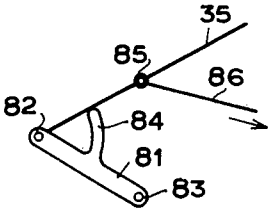
Figure 15D:
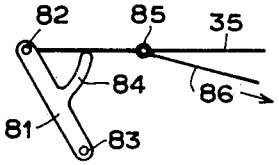
Figure 15E:
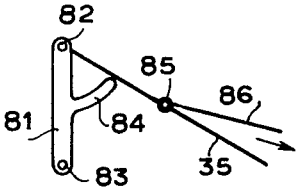

Referring to a further embodiment of this invention shown in FIG. 13, the posture of the reflector plate 35 (i.e., angle of the reflector plate with respect to the display surface) is controlled by means of a slide mechanism which causes at least the ends on one side of the lever 36 and the reflector plate 35 to move along a straight line. The slide mechanism comprises a guide member or a rail 71 which extends along a line which intersects the pivot 39 at a right angle therewith, and a moving member 72 which can move in the lengthwise direction of the rail 71. To the moving member 72 is connected an end of the reflector plate 35 so that it is allowed to rotate about a pivot 73 which is in parallel with the pivot 38. In the same manner as those of the embodiments mentioned hereinbefore, when the lever 36 is rotated about the pivot 39, the pivot 38 rotates about the pivot 39. During the movement, the slide member 32 slides along the rail 71 since the distance remains the same between the pivot 38 and the pivot 73, whereby the reflector plate 35 is caused to turn. Smooth movement can be attained not by turning the lever 36 but by sliding the slide member 72. The reflector plate 35 should be urged by means of spring to be rotated about the pivot 73 in the clockwise direction in order to start its rotation from the position that it lies in parallel with the rail 71.

Figure 14:
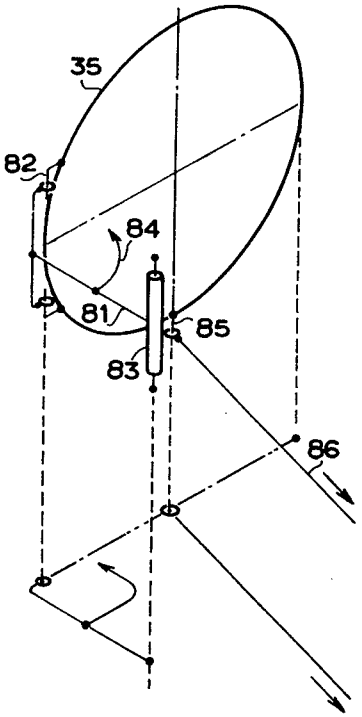
FIG. 14 is a perspective view schematically showing a major portion of a still further display unit embodying this invention.
Figure 12A:
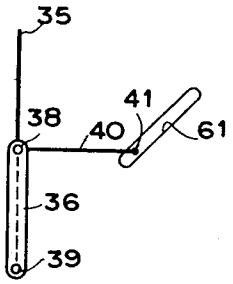
FIGS. 12*a* to 12*e* are side views schematically showing the steps according to which the reflector plate and lever of the display unit of FIG. 10 move from the display position toward the non-display position.
Figure 12B:
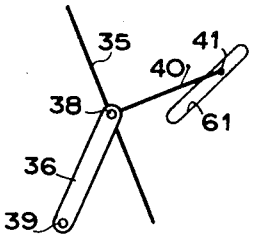
Figure 12C:
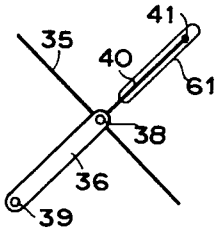

FIG. 14 shows a further embodiment for moving the reflector plate 35 between the display position and the non-display position, in which the reflector plate 35 is so supported at an end of a lever 81 as to turn about a pivot 82. The lever 81 is supported at an end portion on the side opposite to the pivot 82 by the casing (not shown) in such a manner as to turn about a pivot 83 and has, at a central portion in the lengthwise direction thereof, an extension 84 which terminates at a position maintaining a suitable distance with respect to the back surface of the reflector plate 35 when it is located at the display position. The force required for moving the reflector plate 35 from the display position shown in FIG. 14 is obtained from a drive rod 86 which is connected to the reflector plate 35 via a pivot 85. Changes in positions of the reflector plate 35 and lever 81 during the step in which the reflector plate 35 moves from the display position to the non-display position are sequentially shown in FIGS. 15*a* to 15*e*. During the initial stage of the movement, the reflector plate 35 rotates about the pivot 82. After the reflector plate 35 comes into contact with the extension 84, the reflector plate 35 is not longer allowed to turn with respect to the lever 81 so that the reflector plate 35 will rotate about the pivot 83 together with the lever 81. The movement from the non-display position to the display position is carried out in reverse order.

Figure 16:
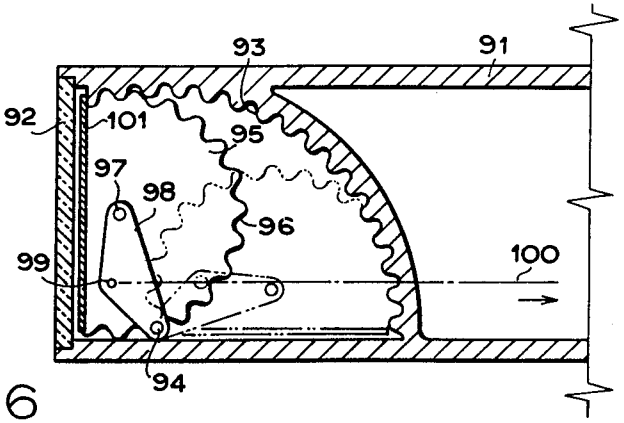
FIG. 16 is a longitudinal section showing a portion of a display unit according to a further embodiment of this invention.

Referring to FIG. 16 showing another modification embodying the invention, a casing 91, formed in a cylindrical shape with nearly a square cross section, has a transparent front wall 92 attached to an end thereof. On the opposing side walls are formed a series of teeth 93 arranged on an arc with a pivot 94 as a center. The teeth 93 are in mesh with teeth 96 of a gear 95 which constitutes a portion of a circular disc. The gear 95 is connected to an end of a lever 98 by means of a pivot 97 located at the center of the gear 95. The lever 98 is connected at its other end to the casing 91 via a pivot 94. To the central portion of the lever 98 is connected a drive rod 100 via a pivot 99. A reflector plate 101 is attached at its both ends to the flat surfaces of each of the gears 95 by a suitable fastening means.

In FIG. 16, the solid lines indicate the positions of the reflector late 101, gear 95 and lever 98 when they are located at the display position. In this state, the movement of the drive rod 100 in the direction of arrow causes the lever 98 to rotate clockwise. The pivot 94 is located at the center of the arc along which the teeth 93 are arrayed, and the pivot 97 is in conformity with the center of the gear 95. Therefore, when the lever 98 is turned clockwise, the gear 95 rotates clockwise about the pivot 94 being in mesh with the teeth 93 and revolves counterclockwise about the pivot 97. When the lever 98 is turned by an angle of about 90 degrees, the lever 98, gear 95 and reflector plate 101 travel to the positions indicated by double-dotted chain lines in FIG. 16.

As mentioned above, the display unit according to this invention is provided with a reflector plate which moves between the display position and the non-display position based upon a composite movement of a rotating movement with an end portion of the reflector plate as a center and a movement by which the reflector plate leaves from, or is brought close to, the display surface. Owing to such a mode of movement, the reflector plate is allowed to be properly positioned on the display surface. Where the display surface is formed on the inner surface of a transparent plate, the surface of reflection of the reflector plate which comes into contact with the transparent surface presents an effect of clear display. Another advantage of this invention is that the reflector plate and various elements for carrying the reflector plate are accommodated in the hermetically sealed casing. The display unit maintains stable operation for extended periods of time even when it is used outdoors.

What is claimed is:

1. A magnetically operated display unit for use in displaying characters or figures at two stable positions comprising:

a hermetically sealed casing having a transparent front wall;

a reflector plate which is movable between a display position at which said reflector plate is disposed in the proximity to or in contact with the inner surface of said front wall and a non-display position apart from said display position inside said casing; and driving means for moving said reflector plate in such a manner that said reflector plate is rotated about a first pivot located on a plane in parallel with the front surface of said reflector plate while said reflector plate moves between said display position and said non-display position, and that said first pivot undergoes displacement with respect to said plane, said driving means further comprising a lever which is connected at its one end to said reflector plate so as to rotate about said pivot and is connected at its other end to said casing so as to rotate about a second pivot in parallel with said first pivot, lever drive means for driving said lever about said second pivot over a predetermined range, and control means for controlling the direction of said reflector plate in the course of the rotation of said lever.

2. A display unit as defined in claim 1 wherein said control means comprises (a) a cam having a pair of engaging surfaces provided for rotating the plate by contacting with the back surface of said reflector plate at each time after it leaves said display position and said non-display position, (b) an engaging member provided on the back surface of said reflector plate, and (c) a projection which comes into engagement with said engaging member after the back surface of said reflector plate becomes into contact with one of said engaging surfaces.

3. A display unit as defined in claim 1 wherein said lever drive means has a drive rod which is connected at its one end to said lever and movable in the lengthwise direction thereof.

4. A display unit as defined in claim 1 wherein said lever means comprises a pair of permanent magnet pieces attached to said lever, and a solenoid disposed at a position opposed to said permanent magnet pieces.

5. A display unit as defined in claim 1 wherein said control means comprises a second lever which is located behind said first pivot, and is connected at its one end to a third pivot that is in parallel with said first pivot, and also to said casing in a manner to be rotatable about a fourth pivot in a parallel with said third pivot.

6. A display unit as defined in claim 1 wherein said lever drive means comprises a swing arm supported by said casing via a fifth pivot which is in parallel with said first pivot, a pair of permanent magnet pieces opposed to said swing arm with maintaining a predetermined distance in regard to the swing direction, a solenoid secured to said casing at a position between said permanent magnet pieces, and a drive rod which connects said swing arm to said lever.

7. A display unit as defined in claim 6 wherein said solenoid is fitted to a printed circuit board which is fastened to said casing.

8. A display unit as defined in claim 1 wherein said control means comprises a third pivot which is located behind said first pivot and is in parallel therewith, and a groove extending along a plane which includes said first pivot, said groove receiving an end portion of said third pivot.

9. A magnetically operated display unit for use in displaying characters for figures in two stable positions comprising:

(a) a hermetically sealed casing having a transparent front wall;

(b) a reversible reflector plate which is movable between a display position at which said reflector plate is disposed in the proximity to or in contact with the inner surface of said front wall and a non-display position apart from said display position inside said casing;

(c) driving means for moving said reflector plate in such a manner that said reflector plate is rotated about a first pivot located on a plane in parallel with the front surface of said reflector plate while said reflector plate moves between said display position and said non-display position, and that said first pivot undergoes displacement with respect to said plane;

said driving means further comprising (d) a lever which is rotatably supported at its one end by said casing and is rotatably connected at its other end to an end portion of said reflector plate;

(e) an extension formed on said lever for restricting the rotation of said reflector plate with respect to said lever by contacting with said reflector plate immediately after it has started to move from said display position to said non-display position thereby to prevent relative rotation between said reflector plate and said lever;

(f) reflector plate drive means for moving said reflector plate between said display position and said non-display position.

10. A magnetically operated display unit for use in displaying characters in figures in two stable positions comprising:

(a) a hermetically sealed casing having a transparent front wall;

(b) a reversible reflector plate which is movable between a display position at which said reflector plate is disposed in the proximity to or in contact with the inner surface of said front wall and a non-display position apart from said display position inside said casing;

(c) driving means for moving said reflector plate in such manner that said reflector plate is rotated about a first pivot located on a plane in parallel with the front surface of said reflector plate while said reflector plate moves between said display position and said non-display position, and that said first pivot undergoes displacement with respect to said plane;

said driving means further comprising a series of teeth arrayed along an arc inside said casing, a gear which comes in mesh with said teeth, and a lever for connecting said gear to said casing, and said lever being rotatably connected at its one end to the center of said gear and rotatably connected at its other end to said casing.

* * * * *

UNITED STATES PATENT AND TRADEMARK OFFICE

CERTIFICATE OF CORRECTION

PATENT NO. : 4,273,396

DATED : June 16, 1981

INVENTOR(S) : Teragaki et al.

It is certified that error appears in the above–identified patent and that said Letters Patent are hereby corrected as shown below:

In column 4, line 35, "electric is fed" should read "electric current is fed".

In column 8, line 41, "late" should be "plate".

Signed and Sealed this

*Twenty-ninth* Day of *December 1981*

[SEAL]

*Attest:*

GERALD J. MOSSINGHOFF

*Attesting Officer*

*Commissioner of Patents and Trademarks*